US005672183A

United States Patent [19]

Schield

[11] Patent Number: 5,672,183

[45] Date of Patent: Sep. 30, 1997

[54] ANTI-STATIC ADDITIVES FOR HYDROCARBONS

[75] Inventor: John A. Schield, Chesterfield, Mo.

[73] Assignee: Petrolite Corporation, St. Louis, Mo.

[21] Appl. No.: 674,076

[22] Filed: Jul. 1, 1996

[51] Int. Cl.[6] ..... C10L 1/18; C10L 1/22

[52] U.S. Cl. ..... 44/386; 44/393; 44/394; 44/397; 44/412; 44/422

[58] Field of Search ..... 44/422, 412, 397, 44/394, 393, 386

[56] References Cited

U.S. PATENT DOCUMENTS

| | | | |
|---|---|---|---|
| 3,062,630 | 11/1962 | Di Piazza | 44/422 |
| 3,186,810 | 6/1965 | Dunworth | 44/422 |
| 3,578,421 | 5/1971 | Andress et al. | 44/62 |
| 3,652,238 | 3/1972 | Bialy et al. | 44/62 |
| 3,677,724 | 7/1972 | Andress | 44/62 |
| 3,677,725 | 7/1972 | Andress | 44/62 |
| 3,758,283 | 9/1973 | Matt | 44/62 |
| 3,807,977 | 4/1974 | Johnston et al. | 44/62 |
| 3,811,848 | 5/1974 | Johnson | 44/62 |
| 3,917,466 | 11/1975 | Henry, Jr. | 44/62 |
| 4,211,534 | 7/1980 | Feldman | 44/394 |
| 4,333,741 | 6/1982 | Naiman et al. | 44/62 |
| 5,039,437 | 8/1991 | Martella et al. | 252/48.2 |
| 5,082,470 | 1/1992 | Martella et al. | 44/304 |
| 5,254,138 | 10/1993 | Kurek | 44/422 |

OTHER PUBLICATIONS

Lewis, Richard J. Sr., ed., *Hawley's Condensed Chemical Dictionary*, 12th ed., p. 1216.

Henry, Cyrus P., Jr., "Electrostatic Hazards and Conductivity Additives", *Fuel Reformulation*, Jan./Feb. 1993, pp. 23–28.

*Primary Examiner*—Jacqueline V. Howard

*Attorney, Agent, or Firm*—Kenneth Solomon

[57] ABSTRACT

A composition having increased electrical conductivity, comprising a liquid hydrocarbon and an anti-static amount of a hydrocarbon soluble copolymer of an alkylvinyl monomer and a cationic vinyl monomer. The copolymer has an alkylvinyl monomer unit to cationic vinyl monomer unit ratio of from about 1:1 to about 10:1, and has an average molecular weight of from about 800 to about 1,000,000. Other related compositions and methods for measuring electrical conductivity of liquids are also disclosed.

52 Claims, No Drawings

ANTI-STATIC ADDITIVES FOR HYDROCARBONS

BACKGROUND OF THE INVENTION

1. Field of the Invention

This invention relates to chemical additives for increasing hydrocarbon conductivity, and more particularly to halogen-free acrylate copolymer compositions that increase the conductivity of liquid hydrocarbons, such as solvents and fuels, and thereby control the build-up of potentially hazardous static charges in such liquids, and to methods of making and using such compositions.

2. Description of the Related Art

It is widely known that electrostatic charges can be frictionally transferred between two dissimilar, nonconductive materials. When this occurs, the electrostatic charge thus created appears at the surfaces of the contacting materials. The magnitude of the generated charge is dependent upon the nature of and, more particularly, the respective conductivity of each material.

Perhaps the most well-known examples of electrostatic charge build-up include those which occur when one shuffles across a carpeted floor or when one runs one's hand across another's hair or the fur of an animal. Although it is less commonly known, electrostatic charging can also occur when a solid is mixed with a liquid and when water settles through a hydrocarbon solution. It is the latter situations that are of greatest interest to the petroleum industry, for when such charges are built up in or around flammable liquids, their eventual discharge can lead to incendiary sparking, and perhaps to a serious fire or explosion.

While incendiary sparking is a ubiquitous problem in the petroleum industry, the potential for fire and explosion is probably at its greatest during product handling, transfer and transportation. For example, static charges are known to accumulate in solvents and fuels when they flow through piping, especially when these liquids flow through high surface area or "fine" filters and other process controls such as is common during tank truck filling. Countermeasures designed to prevent accumulation of electrostatic charges on a container being filled and to prevent sparks from the conducting container to ground can be employed, such as container grounding (i.e. "earthing") and bonding. But it has been recognized that these measures are inadequate to deal successfully with all of the electrostatic hazards presented by hydrocarbon fuels.

Alone, grounding and bonding are not sufficient to prevent electrostatic build-up in low conductivity, volatile organic liquids such as distillate fuels like diesel, gasoline, jet fuel, turbine fuels and kerosene. Similarly, grounding and bonding do not prevent static charge accumulation in relatively clean (i.e. contaminant free) light hydrocarbon oils such as organic solvents and cleaning fluids. This is because the conductivity of these organics is so low that a static charge moves very slowly through these liquids and can take a considerable time to reach the surface of a grounded, conductive container. Until this occurs, a high surface-voltage potential can be achieved which can create an incendiary spark. Ignition or explosion can thus occur in an environment of air-hydrocarbon vapor.

One can directly attack the source of the increased hazard presented by these low conductivity organic liquids by increasing the conductivity of the liquid with additives. The increased conductivity of the liquid will substantially reduce the time necessary for any charges that exist in the liquid to be conducted away by the grounded inside surface of the container. Various compositions are known for use as liquid hydrocarbon additives to increase the electrical conductivity of these liquids. For example, in U.S. Pat. Nos. 3,578,421, 3,677,724, 3,807,977, 3,811,848 and 3,917,466 there are described anti-static additives generally of the alpha-olefin-sulfone copolymer class. In U.S. Pat. No. 3,677,725 an anti-static additive of the alpha-olefin-maleic anhydride copolymer class is described. Anti-static amines and methyl vinyl ether-maleic anhydride copolymers are described in U.S. Pat. No. 3,578,421. Still further, anti-static aliphatic amines-fluorinated polyolefins are described in U.S. Pat. No. 3,652,238. Similarly, anti-static chromium salts and amine phosphates are disclosed in U.S. Pat. No. 3,758,283. And, in U.S. Pat. No. 4,333,741 there are disclosed olefin-acrylonitrile copolymers for use as anti-static additives in hydrocarbons.

The olefin-acrylonitrile copolymeric compositions, as indicated above, have proved effective as anti-static agents or "static dissipators," as they are also known, when combined with volatile liquid hydrocarbons.

In the past, halogen-containing compositions introduced into fuels have played a significant role in achieving anti-static properties in fuels. While these halogen-containing compositions are effective as anti-static agents, in certain situations, some halogen-containing hydrocarbon compounds have been linked to human and animal health risks as well as environmental degradation. Recent legislative enactments, including the 1990 amendment to "The Clean Air Act" in the United States, signal a trend away from the continued permissible use in some media of compositions containing halogens. Even where the use of halogen-containing compositions is still permitted, stringent regulations often govern the use, storage and, in particular, the disposal of and/or treatment of waste streams containing these compositions. Such factors call into question the continued practical and economic feasibility of anti-static agents containing halogens without regard to the media being treated.

Other prior art compositions have necessarily contained as much as about 10% (by weight of active ingredients) sulfur in a form that increases or creates sulfur contamination of the fuels or other fluids upon their addition thereto. Sulfur in various forms, such as sulfur dioxide, is well known as an undesirable contaminant. Its undesirability is due to a variety of reasons, including the problems it causes in handling and its interference with, or undesirable side effects encountered in, the end uses of the sulfur-contaminated fluid. While the presence of sulfur in certain forms in certain fluids is acceptable, it is preferred for those instances to have the option to prepare a formulation without undesirable forms of sulfur.

A need has therefore clearly arisen for an effective, low cost anti-static agent that is useful with a wide variety of volatile hydrocarbon liquids. It is especially desirable in many situations that the agent be free of halogens. Other desirable embodiments would have on the order of 1% by weight sulfur or be even free of sulfur, or at least free of sulfur in a form such as sulfur dioxide that would cause an undesirable sulfur-contamination of the medium being treated.

SUMMARY OF THE INVENTION

Briefly, therefore, the present invention is directed to a novel composition having increased electrical conductivity, comprising a liquid hydrocarbon and an anti-static amount of a hydrocarbon soluble copolymer of an alkylvinyl monomer and a cationic vinyl monomer in a ratio of from about 1:1 to about 10:1. The copolymer has an average molecular weight of from about 800 to 1,000,000.

The present invention is also directed to a novel composition having increased electrical conductivity, comprising a liquid hydrocarbon and an anti-static amount of a hydrocarbon soluble copolymer comprising x monomer units corresponding to the formula

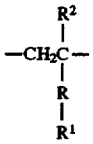

and y monomer units corresponding to the formula

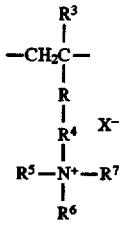

wherein $X^-$ is a nonhalogen anion, R is —C(:O)O—, —C(:O)NH—, a straight chain or branched alkylene group, a divalent aromatic group or a divalent alicyclic group, $R^1$ is a straight chain or branched alkyl of up to about twenty carbon atoms, $R^2$ and $R^3$ are independently selected from among hydrogen and methyl, $R^4$ is a straight chain or branched alkylene of up to about twenty carbon atoms, $R^5$, $R^6$ and $R^7$ are independently each a straight chain or branched alkyl of up to about twenty carbon atoms, and x and y are selected such that the copolymer has an average molecular weight of from about 800 to 1,000,000 and x/y is from about 1 to about 10.

The present invention is further directed to a novel method for reducing accumulated static electrical charge on a surface of a liquid hydrocarbon, comprising adding to the liquid hydrocarbon an anti-static amount of a hydrocarbon soluble copolymer of an alkylvinyl monomer and a cationic quaternary ammonium vinyl monomer in a molar ratio of from about 1:1 to about 10:1, the copolymer having an average molecular weight of from about 800 to 1,000,000.

The present invention is also directed to a hydrocarbon soluble copolymer of an alkylvinyl monomer and a cationic vinyl monomer in a molar ratio of from about 1:1 to about 10:1. The copolymer has an average molecular weight of from about 800 to 1,000,000.

Among the several advantages found to be achieved by the present invention, therefore, may be noted the provision of a composition and method that provides improved anti-static properties for a variety of media; the provision of such composition and method that does not require the use of halogens in all situations; the provision of such composition and method that allows use of lower levels of sulfur, patentability that does not require the use of sulfur in an environmentally unacceptable form; and the provision of such composition that may be produced with relatively low cost and waste.

DETAILED DESCRIPTION OF THE PREFERRED EMBODIMENTS

In accordance with the present invention, it has been discovered that the electrical conductivity of an organic liquid, such as a liquid hydrocarbon (particularly a volatile liquid hydrocarbon), can be increased and therefore the build up of static charges therein decreased by incorporating into the liquid a hydrocarbon-soluble copolymer of an alkylvinyl monomer and a cationic vinyl monomer, especially a cationic quaternary ammonium vinyl monomer, wherein the alkylvinyl monomer unit to cationic vinyl monomer unit ratio is from about 1:1 to about 10:1 and the copolymer has an average molecular weight of from about 800 to 1,000,000. Significantly, such anti-static compositions can be formulated as halogen-free (and even low (i.e., about 1% by weight or less) sulfur and free of sulfur in environmentally unacceptable forms, such as $SO_2$, or even totally sulfur-free, if so desired), are effective without adulterating the liquid hydrocarbon in a way that would adversely affect the hydrocarbon with respect to its intended use, and are relatively simple and inexpensive to formulate using readily available commercial constituents and processing equipment. And when sulfur is included in the composition, it is usually in the form of a sulfate that is relatively unoffensive and easily dealt with. And even then, the sulfur content can be maintained at less than about 5% by weight of the active ingredients, especially about 1% by weight or less. Moreover, it has been further discovered that, surprisingly, the anti-static efficacy of the additive compositions of this invention can be increased even more by the inclusion therein of certain hydrocarbon-soluble nitrilic polymers, magnesium or aluminum overbases or polyvalent metal salts, particularly when the organic liquid being treated is highly refined.

Although anti-static additives for fuel must be oil soluble[1], monomers containing cationic functionality are generally water soluble. Thus, it is surprising that the anti-static compositions of the present invention would be produced from such monomers. Although polymers and copolymers made from water soluble monomers are generally water soluble rather than oil soluble, the anti-static additives of the present invention are, unexpectedly, oil soluble. Moreover, certain of the nitrilic polymers found to improve the anti-static efficacy of the noted copolymers of this invention have themselves been found to have some anti-static efficacy as discussed in U.S. Pat. No. 4,333,741. Because they are used in the present invention as an aid to the noted copolymers, they may be used in lower concentrations than they would be if used as the sole anti-static agent.

[1]In this description, the terms "oil soluble" and "hydrocarbon soluble" are used interchangeably to describe solubility in the organic liquids to which the composition described as oil or hydrocarbon soluble is to be added; for example, solvents and fuels. "Soluble" means at least dispersibility and preferably ready solubility in the organic liquid at the concentration of interest, as discussed below.

The subject copolymers are hydrocarbon soluble copolymers of an alkylvinyl monomer and a cationic vinyl monomer. As used herein, the term "vinyl" is used in its broader sense to refer not merely to the moiety $CH_2$:CH—, but to generally to isopropenyl (i.e., $CH_2$:C($CH_3$)—) and other related moieties of the form $CH_2$:C($R^2$)—, wherein $R^2$ may be an alkyl of up to about twelve or eighteen carbon atoms, but usually simply hydrogen or methyl.

The alkylvinyl monomer, therefore, preferably corresponds to the formula $CH_2$:C($R^2$)R—$R^1$ wherein R is —C(:O)O—, —C(:O)NH—, a straight chain or branched alkylene group, a divalent aromatic group or a divalent alicyclic group, preferably —C(:O)O—, —C(:O)NH— or an alkylene group, more preferably —C(:O)O— or —C(:O)NH—, $R^1$ is a straight chain or branched alkyl of up to about twenty carbon atoms, preferably about six to about twelve carbon atoms, and $R^2$ is hydrogen or an alkyl group of up to about eighteen carbon atoms, preferably up to about twelve carbon atoms, more preferably up to about six carbon atoms and even more preferably up to about two carbon atoms. Because hydrocarbon solubility may decrease with increasing chain length and because of the cost and availability of raw materials, it is highly preferred that $R^2$ is hydrogen or methyl. It is desirable that R contain no more than about twelve carbon atoms, more desirably no more than about six carbon atoms. Due to availability of starting materials and ease of synthesis, most preferably, R is —C(:O)O—, in which case the monomer is an alkylacrylate monomer if $R^2$ is hydrogen and is an alkylmethacrylate monomer if $R^2$ is methyl. Synthesis techniques for preparation of such monomers are well known. In particular, ethylhexylacrylate has been found to be suitable.

The cationic vinyl monomer preferably corresponds to the formula

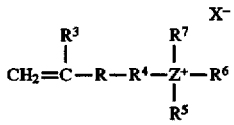

wherein Z is nitrogen, phosphorus or sulfur, $X^-$ is an anion, especially a nonhalogen anion, R is as defined above, $R^3$ is defined in accordance with the definition of $R^2$ above, $R^4$ is a straight chain or branched alkylene of up to about twenty carbon atoms, and $R^5$, $R^6$ and $R^7$ are independently each a straight chain or branched alkyl of up to about twenty carbon atoms. If Z is sulfur, however, $R^7$ is absent. It is preferred that Z is nitrogen or phosphorus and highly preferred that Z be nitrogen. Thus, highly preferred cationic vinyl monomers are cationic quaternary ammonium vinyl monomers. For reasons of hydrocarbon solubility and the cost and availability of raw materials, it is preferred that $R^4$ be an alkylene of two to about four carbon atoms. For similar reasons, $R^5$, $R^6$ and $R^7$ are preferably alkyls of up to about four carbon atoms. More preferably $R^5$, $R^6$ and $R^7$ are all the same; most preferably all are methyl. In accordance with the definitions and preferred forms of R and $R^3$ (in the latter case, as discussed particularly with respect to $R^2$) as set forth above, preferred cationic quaternary ammonium vinyl monomers are cationic quaternary ammonium acrylate monomers and cationic quaternary ammonium methacrylate monomers. Thus, in a preferred embodiment, X may be nitrogen, R may be —C(:O)O—, $R^3$ may be methyl, $R^4$ may be ethylene, and $R^5$, $R^6$ and $R^7$ may each be methyl; to wit:

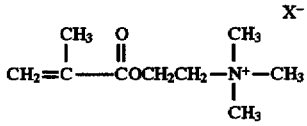

Suitable nonhalogen anions for $X^-$ will be readily apparent to those of ordinary skill in the art. Exemplary of such anions may be noted nitrate ions, sulfate ions, hydroxide ions and so forth. In many cases, $X^-$ may be the anion from a quaternization agent used in the synthesis of the cationic vinyl monomer. Thus, for instance, where the monomer has been quaternized with methyl sulfate (which is actually the common name for dimethyl sulfate), one of the methyl groups from the methyl sulfate may bond to the nitrogen (or other Z) and therefore correspond to one of $R^5$, $R^6$ or $R^7$ and $X^-$ would correspond to the demethylated methyl sulfate, $CH_3SO_4^-$, referred to herein as the monomethyl sulfate ion.

The hydrocarbon soluble copolymer of the alkylvinyl monomer and the cationic vinyl monomer may be produced from those monomers by standard and well known polymerization techniques. Generally, the alkylvinyl monomer will be reacted with the cationic vinyl monomer in a molar ratio of from about 1:1 to about 10:1 preferably from about 2:1 to about 5:1, such as about 4:1. The resulting hydrocarbon soluble copolymer, therefore, comprises x monomer units corresponding to the formula

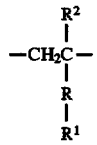

and y monomer units corresponding to the formula

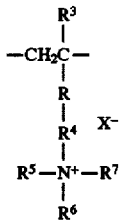

wherein $X^-$, R, $R^1$, $R^2$, $R^3$, $R^4$, $R^5$, $R^6$ and $R^7$ are as defined above, and x and y are selected such that the copolymer has an average molecular weight low enough to provide hydrocarbon solubility up to the concentration desired in the hydrocarbon to be treated (e.g., about 1 to about 100 ppm by weight), and x/y is likewise within a range that provides sufficient hydrocarbon solubility. Generally sufficient hydrocarbon solubility is maintained if the average molecular weight of the copolymer is from about 800 to about 1,000,000, preferably about 800 to about 500,000, most preferably about 800 to about 100,000, and if x/y is from about 1 to about 10, preferably about 2 to about 5, most preferably about 4. It is preferred that the molecular weight be maintained below 1,000,000, even more preferably even significantly lower such as to ensure sufficient oil solubility.

Most preferably, also, the monomer units derived from the alkylvinyl monomer and from the cationic vinyl monomer are the only monomers in the polymer, although even in such case, the monomer units may be derived from more than one type of alkylvinyl monomer and/or cationic vinyl monomer corresponding to the definitions above. Nevertheless, in the most desirable embodiment, all alkylvinyl monomer units in the polymer are the same and all the cationic vinyl monomer units in the polymer are the same. The resulting polymer may be a block copolymer, an alternating copolymer or a random copolymer as desired and in accordance with the synthesis scheme.

It has been found that the electrical conductivity of an organic liquid can be increased significantly by incorporating into the liquid a small, but effective anti-static, amount of the copolymer of this invention. This is particularly advantageous for many such liquids, such as liquid hydrocarbons (particularly a volatile liquid hydrocarbons), that tend to have low electrical conductivity and consequently are prone to building up static charges and producing electrical shocks or sparks. By increasing the electrical conductivity of the liquid, the build up of static charges therein decreased, thereby reducing the risk of electrical spark or shock formation. It has been found that in many cases as little as, for example, a concentration of about 1 to about 100 ppm by weight of the copolymer is sufficient to provide substantial anti-static efficacy. Moreover, these copolymers have been found to be surprisingly efficacious even in media in which, for example, the compounds of U.S. Pat. No. 4,333,741 have been found not to be nearly as efficacious as desired.

The copolymer may be incorporated into the hydrocarbon liquid in any of a number of forms. It may be added directly to the liquid, for example, in pure state or in a dilute state, such as resulting from addition of an organic solvent (e.g., xylene) or other diluent or carrier fluid; recognizing, however, that it is preferred that the resulting additive be free of halogens and free or of low content of offensive sulfur. Exemplary of such diluents or carrier fluids may be noted kerosene or a volume of the fluid to which the copolymer is to be added. Alternatively, the copolymer may be left in the mixture resulting from the polymerization reaction and the mixture added to the liquid to be treated.

Other carrier fluids and agents, as desired may be incorporated into whatever copolymer-containing composition is to be added to the fluid. Among such agents may be noted hydrocarbon-soluble nitrilic polymers, magnesium or aluminum overbases and polyvalent metal salts. These agents have been found to improve the anti-static properties substantially and surprisingly over that of the previously described copolymers alone or the agents alone, particularly when the organic liquid being treated is highly refined. Highly refined hydrocarbon liquids are those that have a sulfur content of 500 ppm by weight or less. Examples of highly refined hydrocarbons include diesel fuel, gasoline, heating oil, jet fuel and organic solvents such as cleaning solvents. Cleaning solvents are volatile and combustible and so a spark in the head space can lead to an explosion. Cleaning solvents are generally paraffin solvents, typically low molecular alkanes, such as $C_5$ to $C_8$ alkanes; for example, hexanes, pentanes and mixtures thereof.

Preferred nitrilic polymers have a molecular weight of from about 1,000 to about 1,000,000, preferably about 1,000 to about 500,000, especially about 1,000 to about 100,000. Although it is believed that any nitrile-containing polymer may have some efficacy, preferred embodiments are copolymers of alkylvinyl monomers and acrylonitrile in a molar ratio of from about 2:1 to about 1:5, or copolymers of 1-alkenes of from about six to about twenty-eight carbon atoms and acrylonitrile in a molar ratio of from about 2:1 to about 1:5 as described in U.S. Pat. No. 4,333,741. However, because it is believed that any nitrile-containing polymer, such as poly(butadiene-acrylonitrile) diols, would improve the efficacy of the additive composition, all nitrile-containing polymers are contemplated within the scope of this aspect of the invention, particularly if they are hydrocarbon-soluble as defined in this specification.

The alkylvinyl monomer from which the copolymers of alkylvinyl monomers and acrylonitrile may be prepared as described above with respect to the copolymer of the alkylvinyl monomer with the cationic vinyl monomer. The acrylonitrile may be of the standard formula $C_2$:CHCN, or it may be substituted; to wit, $CH_2$:C($R^2$)CN, wherein $R^2$ is an alkyl of up to about twelve or eighteen carbon atoms, but usually simply methyl. Thus, the acrylonitrile may be defined generally as $CH_2$:C($R^2$)CN, wherein $R^2$ is hydrogen or an alkyl group of up to about eighteen carbon atoms, preferably up to about twelve carbon atoms, more preferably up to about six carbon atoms and even more preferably up to about two carbon atoms. Because hydrocarbon solubility may decrease with increasing chain length and because of the cost and availability of raw materials, it is highly preferred that $R^2$ is hydrogen or methyl.

The hydrocarbon soluble nitrilic polymer, therefore, may be a copolymer of the alkylvinyl monomer and acrylonitrile (substituted or unsubstituted) that may be produced from those monomers by standard and well known polymerization techniques. Generally, the alkylvinyl monomer will be reacted with the acrylonitrile in a molar ratio of from about 2:1 to about 1:5, preferably from about 2:1 to about 1:2, more preferably 3:2 to about 1:2, even more preferably about 1:1 to about 1:2, most preferably about 1:1.2 to about 2:3, such as about 1:1.2. The resulting hydrocarbon soluble copolymer, therefore, comprises m monomer units corresponding to the formula

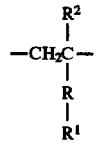

and n monomer units corresponding to the formula

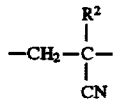

wherein R, $R^1$ and each $R^2$, independently, are as defined above, and m and n are selected such that the copolymer has an average molecular weight low enough and the ratio of m to n is within a range such that the copolymer is hydrocarbon soluble at the concentration level to be employed. Generally, this corresponds to an average molecular weight of from about 800 to about 1,000,000, preferably about 800 to about 500,000, most preferably about 800 to about 100,000 and a value of m/n of from about 0.5 to about 5. It is preferred that the molecular weight be maintained below 1,000,000, even more preferably even significantly lower such as to ensure sufficient oil solubility.

It has been found that increasing conductivity can be achieved from lower m/n ratios. Thus, greater conductivity improving efficacy has been noted for an m/n ratio of about 1.5 than it has for an m/n ratio of about 5, and greater conductivity improving efficacy, in turn, has been found for an m/n ratio of about 0.67 than it has for an m/n ratio of about 1.5. However, the need for a sufficiently high m to impart necessary oil solubility imparts a lower limit of the m/n ratio. Accordingly, the value of m/n is desirably from about 0.5 to about 5, preferably about 0.5 to about 2, most preferably about 0.67 (i.e., 1/1.5) to about 0.83 (i.e., 1/1.2), such as about 0.67 or about 0.83.

The resulting copolymer may be a block copolymer, an alternating copolymer or a random copolymer as desired and in accordance with the synthesis scheme.

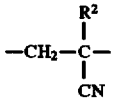

Although the monomer units derived from the alkylvinyl monomer and from the acrylonitrile are the only monomers in the polymer (recognizing, however, that the monomer units may be derived from more than one type of alkylvinyl monomer and/or acrylonitrile corresponding to the definitions above), other monomer units may be included as well—at least so long as they do not interfere deleteriously with the functionality provided by the noted monomer units or render the copolymer insoluble. For example, the copolymer might also include styrene monomer units. Thus, for example, the copolymer might contain m monomer units corresponding to the formula

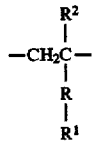

n monomer units corresponding to the formula

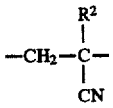

and p monomer units corresponding to the formula

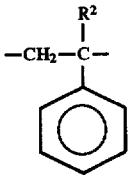

wherein R, $R^1$, each $R^2$, independently, m and n are as defined above, and m+n is perhaps about 5p or 10p or more. For example, m+n might be from about 15p to about 20p, such as about 17:1 to about 18:1. While this has not been found to afford greater efficacy, it permits the use of certain copolymers that are available and recognized as safe, as discussed in Example 2, below.

The ratio of m:n:p can be varied without substantially, if desired, by varying the relative ratios of the constituents, so long as there is an effective amount of nitrile functionality for conductivity enhancement, and so long as the proportion denoted by "m" is sufficient to provide adequate oil solubility and the proportion denoted by "n" is sufficient to provide adequate conductivity as discussed above. The proportion denoted by "p" is not believed critical and can be zero.

The second class of possible nitrilic polymers contains copolymers of 1-alkenes of from about six to about twenty-eight carbon atoms and acrylonitrile in a molar ratio of from about 1:1 to about 1:5. The full breadth of copolymers as described in U.S. Pat. No. 4,333,741 are believed to be suitable herein as well, with the preferred embodiments therein likewise being considered preferred here. In short, possibilities in this class include $C_{20-24}$ alpha-olefin acrylonitrile copolymers, although chains as short as $C_8$ or as long as $C_{30-35}$ are acceptable, the range being, at the shorter end, an approximate limit to that necessary to maintain desirable oil solubility, and at the longer end, an approximate limit such that the copolymer is not too waxy and hence less soluble in oil.

As noted, while these two classes of nitrilic polymers have been described, other nitrilic polymers, such as poly (butadiene-acrylonitrile)diols are believed to be suitable as well. The key limiting feature in such polymers, aside from the requirement of oil solubility, being merely that they contain nitrile groups.

Polyvalent metal salts, such as alkaline earth metal salts, for example calcium sulfonate and magnesium sulfonate, etc., dispersed in hydrocarbon solutions also have been found to be effective agents for increasing the efficacy of the copolymers of the alkylvinyl monomer and the cationic vinyl monomer, and may be used in this embodiment of the invention instead of (or in addition to) the nitrile polymers. However, from the standpoint of pollution control, the use of alkaline earth metal salts may be less desirable than use of the nitrile synergists listed above.

Alternatively, or in addition thereto, a magnesium—or even aluminum—overbase may be employed to increase the efficacy of the copolymers of the alkylvinyl monomer and the cationic vinyl monomer.

Because each component affords some efficacy on its own, the efficacy increasing agent may be incorporated into the anti-static additive in any proportion relative to the alkylvinyl/cationic vinyl copolymer and still advantageous results are achieved. However, surprising, even synergistic results may be noted within the relative weight ratio range of from about 9:1 to about 1:9. Particularly superior results may be noted within the weight ratio range of from about 2:1 to about 1:2, such as about 1:1. Nevertheless, it may be desirable to adjust this ratio in accordance with the amount of sulfur in the fuel or in accordance with other empirically determined factors to achieve maximum synergy.

Regardless of whether the efficacy-enhancing agent is included, the total amount of active additive required is less than 100 ppm, although concentrations of about 20 ppm are considered to be adequate, and in practice, even 3–10 ppm should be sufficient. It is generally desirable to use these lower values of concentration, primarily for economic reasons, but also to prevent additive interference with end uses of the treated liquid. Also, lower concentrations are less likely to cause the additized fuel to take up water, as can occur under some conditions when surface-active chemicals are present.

The method of increasing the conductivity of the fuel comprises the addition of one of the above compositions to the fuel or hydrocarbon solvent in a concentration effective to increase the conductivity of the fuel or solvent. This method can be carried out efficiently with conventional blending and/or mixing equipment which is widely available and used in the fuel industry.

This invention therefore achieves anti-static properties in fuels by using compositions that are inexpensive to manufacture, and for preferred embodiments, the constituents are readily available and inexpensive. Common processing equipment can be used, and if a halogen-free form is employed, the need for treatment of hazardous waste halogen-containing by-products is eliminated. Normal combustion of fuel treated with preferred additive compositions of this invention is not adversely affected and does not produce hazardous products such as dioxin or other hazardous halogenated products. Moreover, the very low levels of sulfur in these anti-static compositions result in a product that is more environmentally acceptable than commercially available products containing higher levels of sulfur, particularly sulfur in more offensive forms.

The following examples describe preferred embodiments of the invention. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples. In the examples all percentages are given on a weight basis unless otherwise indicated.

EXAMPLE 1

A 250 ml. three-necked round bottom flask was charged with denatured absolute ethanol (15.6 grams) and 2,2'-azobis(2-methylpropanenitrile) (0.10 grams). This solution was then sparged with nitrogen, magnetically stirred, and heated to about 75° C. A solution of 2-ethylhexylacrylate (14.74 grams) and aqueous dimethylaminoethylmethacrylate dimethyl sulfate (7.08 grams of an 80 wt. % solution) in isopropanol (14 grams) was added dropwise over a period of four (4) hours. The resulting solution was maintained at 75° C. for two (2) hours. More 2,2'-azobis(2-methylpropanenitrile) (0.10 grams) was then added and the solution maintained at 75° C. for two (2) more hours. A clear, liquid product resulted having a nonvolatile content of 40 wt. % (the other 60% being solvent) and a Brookfield viscosity of between about 20 to about 30 cps at 21° C. The nonvolatile component is understood to have been a random copolymer of x monomer units of the formula

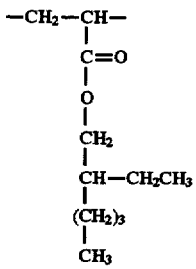

and y monomer units of the formula

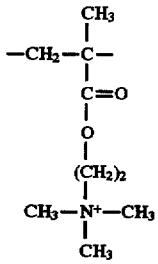

wherein the average numerical ratio of x to y is about 4:1. This ratio was selected to produce an effective, economic product with adequate oil solubility; however, other ratios may be selected by altering the relative proportions of the constituent monomers.

EXAMPLE 2

Six trials were performed. In each of Trial Sets I and II, three samples of high sulfur diesel fuel were tested: (1) a control sample with no additive; (2) a sample to which a combination of an olefin-nitrile polymer and a quaternary ammonium compound ("Combination Additive") was added, and (3) a sample to which a quantity of the product produced in Example 1, above, was added. In Trial Set I, the concentration of each of the Combination Additive and the product of Example 1 in their respective test samples was 5 ppm, whereas in Trial Set II, the concentrations were 10 ppm. Measurements of conductivities of each of the samples were made one hour and twenty-four hours after the additives were added to the fuel. The control sample was also measured at these times. Conductivities of the samples are given in Table I, below, in picoSiemens per meter (pS/m). It will be observed that the conductivity of the samples is significantly increased in samples containing the product of Example I, both relative to the high sulfur diesel fuel without additive, and relative to the samples with the Combination Additive.

Fuels made conductive because of additives tend to lose conductivity over time due to environmental conditions such as temperature and perhaps also humidity, and this loss of conductivity may also be due to the specific composition of the fuel, for example, whether it contains a large proportion of polar molecules. However, it will be observed that in this and in other tests reported herein, decreases in conductivity over time of fuels containing additives in accordance with the present invention are not significantly greater than those containing the Combination Additive and in some cases, the conductivity was unexpectedly observed to increase rather than decrease.

TABLE I

"High" Sulfur Diesel Fuel

| | Trial Set I | | | Trial Set II | | |
|---|---|---|---|---|---|---|
| Additive | ppm | 1 hour pS/m | 24 hour pS/m | ppm | 1 hour pS/m | 24 hour pS/m |
| none | - | 15 | 15 | — | 15 | 16 |
| Combination Additive | 5 | 210 | 179 | 10 | 439 | 318 |
| Example 1 | 5 | 213 | 232 | 10 | 275 | 335 |

An additional test with another high sulfur diesel fuel was performed. These results are shown below in Table II.

TABLE II

Another "High" Sulfur Diesel Fuel

| Additive | ppm | 1 hour (pS/m) | 24 hour (pS/m) |
|---|---|---|---|
| none | — | 3 | 3 |
| Combination Additive | 5 | 221 | 138 |
| Example 1 | 5 | 216 | 128 |

EXAMPLE 3

A 1-liter five-necked round bottom flask was charged with xylene (161.2 grams). The xylene was mechanically stirred and heated to 75° C. under nitrogen. Dropwise addition of a solution of styrene (8.1 grams), 2-ethylhexylacrylate (112.7 grams), acrylonitrile (39.2 grams), and 2,2'-azobis(2-methylbutanenitrile) (3.3 grams) was carried out over a period of five (5) hours. The resulting solution was maintained at 75° C. for thirty (30) minutes. A solution of 2,2'-azobis(2-methylbutanenitrile) (0.5 grams) in xylene (6.7 grams) was next added and the temperature was maintained at 75° C. for two (2) hours. Another solution of 2,2'-azobis(2-methylbutanenitrile) (0.5 grams) in xylene (6.7 grams) was added and the temperature was maintained at 75° C. for eight (8) hours. The resulting product was then treated with dodecylamine (26 grams) and heated at 80° C. for three (3) hours. Finally, xylene (379 grams) was added and the product was stirred for thirty (30) minutes yielding a clear, yellowish and viscous liquid having a nonvolatile content of 21.64 wt. %, the remaining portion being solvent. The nonvolatile component is believe to be a polymer of m units of the formula

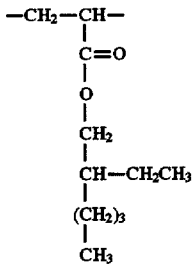

n units of—$CH_2CH(CN)$— and p units of

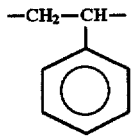

wherein the ratio of m:n:p is about 7.85:9.5:1.

EXAMPLE 4

Table III, below, shows the results of a conductivity experiment performed on two different sets of samples, in a manner consistent with that of Table I described above. Low sulfur diesel fuel was used for testing purposes, and for both trial sets, a control sample of the fuel without any additives was tested. The conductivity of the samples were measured both initially and after a 30 day period. In the case of the samples with additives, the 30 day period commenced on the date on which the additives were added to the sample.

It will readily be seen that a mixture of the compounds of Examples 1 and 3 in one-to-one proportion is effective in substantially increasing the conductivity of the low sulfur diesel fuel. As expected, the increase in conductivity was greater in the sample in which 15 ppm of the additive was present, as compared to the sample in which only 7 ppm was present.

TABLE III

| "Low" Sulfur Diesel Fuel | | | | | | |
|---|---|---|---|---|---|---|
| | Trial Set I | | | Trial Set II | | |
| Additive | ppm | Initial (pS/m) | 30 days (pS/m) | ppm | Initial (pS/m) | 30 days (pS/m) |
| none | — | 3 | 3 | — | 3 | 3 |
| Combination Additive | 7 | 244 | 90 | 15 | 738 | 477 |
| Example 1 + Example 3 (1/1) | 7 | 321 | 105 | 15 | 777 | 415 |

Table IV, below, shows the results of a test in which the Combination Additive of Example 2 and a 1/1 mixture of the products of Examples 1 and 3 were added to separate samples of kerosene to produce a 10 ppm concentration of additive. The conductivity of a control sample and the two samples to which the additives were present were measured after 1 hour and again after 24 hours. (In the case of samples to which additives were present, the time interval is timed from the moment the additive was added to the sample.) It will be seen that the sample to which a mixture of Example 1 and Example 3 was added demonstrated substantially increased electrical conductivity.

TABLE IV

| Kerosene | | | |
|---|---|---|---|
| Additive | ppm | 1 hour (pS/m) | 24 hour (pS/m) |
| none | — | 1 | 1 |
| Combination Additive | 10 | 480 | 440 |
| Example 1 + Example 3 (1/1) | 10 | 620 | 430 |

Table V, below, shows the results of two sets of tests (Trial Sets I and II) in which a commercial blend of diesel fuel was used. Again, in either 3 ppm or 5 ppm concentrations, the conductivity of the fuel was substantially increased when a 1/1 mixture of the products of Examples 1 and 3 were added.

TABLE V

| Diesel Fuel "Commercial Blend" | | | | | | |
|---|---|---|---|---|---|---|
| | Trial Set I | | | Trial Set II | | |
| Additive | ppm | 24 hour (pS/m) | 72 hour (pS/m) | ppm | 24 hour (pS/m) | 72 hour (pS/m) |
| none | — | 1 | 1 | — | 1 | 1 |
| Combination Additive | 3 | 225 | 203 | 5 | 385 | 337 |
| Example 1 + Example 3 (1/1) | 3 | 280 | 244 | 5 | 427 | 404 |

EXAMPLE 5

Further tests were run as described in Example 4, above, but with the polymer of Example 3 containing varying proportions of acrylonitrile units in the polymer. Thus, whereas m/n in Example 3 was 7.85/9.5=0.83, polymers with acrylonitrile contents of 5% (m/n=5.1), 15% (m/n=1.5) and 28.8% (m/n=0.67) were prepared and mixed with the polymer of Example 1 in a ratio of 1:1. The following table shows the results of the tests of 10 ppm dosages of the mixtures in kerosene at 63°–68° F. (17°–20° C.), wherein the initial conductivity measurement was taken immediately after addition of the polymer blend:

| Additive | Initial (pS/m) | 1 hour (pS/m) | 24 hour (pS/m) |
|---|---|---|---|
| none | 1 | 1 | 1 |
| Example 1 + Example 3 with 5% acrylonitrile | 6 | 5 | 7 |
| Example 1 + Example 3 with 15% acrylonitrile | 93 | 95 | 89 |
| Example 1 + Example 3 with 28.8% acrylonitrile | 520 | 450 | 420 |

EXAMPLE 6

Further tests were run as described in Example 4, above, but with a C20-24 alpha-olefin/acrylonitrile copolymer and with a C20-24 alpha-olefin/maleic anhydride copolymer esterified with hydroxypropionitrile and 1-octanol, 1-decanol as the additives. The following table shows the results of the tests of 10 ppm dosages of the additives in kerosene at 63°–68° F. (17°–20° C.), wherein the initial conductivity measurement was taken immediately after addition of the polymer blend:

| Additive | Initial (pS/m) | 1 hour (pS/m) | 24 hour (pS/m) |
|---|---|---|---|
| none | 1 | 1 | 1 |
| C20–24 alpha-olefin/acrylonitrile copolymer | 210 | 135 | 115 |
| C20–24 alpha-olefin/maleic anhydride copolymer ester | 95 | 93 | 110 |

In view of the above, it will be seen that the several advantages of the invention are achieved and other advantageous results attained.

As various changes could be made in the above methods and compositions without departing from the scope of the invention, it is intended that all matter contained in the above description shall be interpreted as illustrative and not in a limiting sense.

What is claimed is:

1. A composition having increased electrical conductivity, comprising a liquid hydrocarbon and an anti-static amount of a hydrocarbon soluble copolymer of an alkylvinyl monomer and a cationic vinyl monomer, wherein the copolymer has an alkylvinyl monomer unit to cationic vinyl monomer unit ratio of from about 1:1 to about 10:1, the copolymer having an average molecular weight of from about 800 to about 1,000,000.

2. A composition as set forth in claim 1 wherein the cationic vinyl monomer is a cationic quaternary ammonium vinyl monomer.

3. A composition as set forth in claim 2 wherein the cationic vinyl monomer is a cationic quaternary ammonium acrylate monomer.

4. A composition as set forth in claim 2 wherein the cationic vinyl monomer is a cationic quaternary ammonium methacrylate monomer.

5. A composition as set forth in claim 1 wherein the cationic vinyl monomer corresponds to the formula

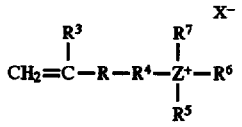

wherein Z is selected from the group consisting of nitrogen, phosphorus and sulfur, $X^-$ is a nonhalogen anion, R is selected from the group consisting of —C(:O)O—, —C(:O)NH—, straight chain and branched alkylene groups, divalent aromatic groups and divalent alicyclic groups, $R^3$ is selected from the group consisting of hydrogen and methyl, $R^4$ is a straight chain or branched alkylene of up to about twenty carbon atoms, and $R^5$, $R^6$ and $R^7$ are independently each a straight chain or branched alkyl of up to about twenty carbon atoms, provided however that if Z is sulfur $R^7$ is absent.

6. A composition as set forth in claim 5 wherein Z is nitrogen, $X^-$ is selected from the group consisting of nitrate, sulfate and hydroxide anions, and R has up to about twenty carbon atoms.

7. A composition as set forth in claim 6 wherein $X^-$ is a monomethylsulfate ion, R is —C(:O)O—, and $R^4$ is an alkylene of from two to about four carbon atoms.

8. A composition as set forth in claim 7 wherein $R^5$, $R^6$ and $R^7$ are each methyl.

9. A composition as set forth in claim 1 wherein the alkylvinyl monomer corresponds to the formula $CH_2{:}C(R^2)$—R—$R^1$, wherein R is selected from the group consisting of —C(:O)O—, —C(:O)NH—, straight chain and branched alkylene groups, divalent aromatic groups and divalent alicyclic groups, $R^1$ is a straight chain or branched alkyl of up to about twenty carbon atoms, $R^2$ is selected from the group consisting of hydrogen and methyl.

10. A composition as set forth in claim 9 wherein R has up to about twelve carbon atoms.

11. A composition as set forth in claim 10 wherein R is —C(:O)O—.

12. A composition as set forth in claim 11 wherein the alkylvinyl monomer is an alkyl acrylate monomer of the formula $CH_2{:}CHC(:O)OR^1$ wherein $R^1$ is as defined in claim 9.

13. A composition as set forth in claim 11 wherein the alkylvinyl monomer is an alkyl methacrylate monomer of the formula $CH_2{:}C(CH_3)C(:O)OR^1$ wherein $R^1$ is as defined in claim 9.

14. A composition as set forth in claim 12 wherein the alkylvinyl monomer is 2-ethylhexylacrylate.

15. A composition as set forth in claim 6 wherein the alkylvinyl monomer corresponds to the formula $CH_2{:}C(R^2)$—R—$R^1$, wherein R is selected from the group consisting of —C(:O)O—, —C(:O)NH—, straight chain and branched alkylene groups, divalent aromatic groups and divalent alicyclic groups, $R^1$ is a straight chain or branched alkyl of up to about twenty carbon atoms, $R^2$ is selected from the group consisting of hydrogen and methyl.

16. A composition as set forth in claim 15 wherein the alkylvinyl monomer is an alkyl acrylate monomer of the formula $CH_2{:}CHC(:O)OR^1$ wherein $R^1$ is as defined in claim 15.

17. A composition as set forth in claim 15 wherein the alkylvinyl monomer is an alkyl methacrylate monomer of the formula $CH_2{:}C(CH_3)C(:O)OR^1$ wherein $R^1$ is as defined in claim 15.

18. A composition as set forth in claim 16 wherein the alkylvinyl monomer is 2-ethylhexylacrylate.

19. A composition as set forth in claim 1 wherein the average molecular weight of the copolymer is from about 800 to about 500,000.

20. A composition as set forth in claim 1 wherein the average molecular weight of the copolymer is from about 800 to about 100,000.

21. A composition as set forth in claim 6 wherein the composition is halogen-free.

22. A composition as set forth in claim 15 wherein the composition is halogen-free.

23. A composition as set forth in claim 1, further comprising an anti-static improving amount of a hydrocarbon soluble agent selected from the group consisting of nitrilic polymers, magnesium and aluminum overbases and polyvalent metal salts.

24. A composition as set forth in claim 23 wherein the agent is a nitrilic polymer.

25. A composition as set forth in claim 24 wherein the nitrilic polymer has a molecular weight of from about 1,000 to about 100,000 and is selected from the group consisting of copolymers of alkylvinyl monomers and acrylonitrile in a molar ratio of from about 2:1 to about 1:5, copolymers of 1-alkenes of from about six to about twenty-eight carbon atoms and acrylonitrile in a molar ratio of from about 2:1 to about 1:5, and poly(butadiene-acrylonitrile) diols.

26. A composition as set forth in claim 25 wherein the nitrilic polymer is selected from the group consisting of copolymers of alkylvinyl monomers and acrylonitrile in a molar ratio of from about 2:1 to about 1:5, and copolymers of 1-alkenes of from about six to about twenty-eight carbon atoms and acrylonitrile in a molar ratio of from about 2:1 to about 1:5.

27. A composition as set forth in claim 26 wherein the copolymer further comprises styrene monomer units in a numerical average nitrile monomer unit to styrene monomer unit ratio of from about 5:1 to about 20:1.

28. A composition as set forth in claim 26 wherein the nitrilic polymer is present in a nitrilic polymer to hydrocarbon soluble copolymer ratio of from about 9:1 to about 1:9.

29. A composition as set forth in claim 26 wherein the nitrilic polymer is selected from the group consisting of copolymers of alkylvinyl monomers and acrylonitrile in a molar ratio of from about 2:1 to about 1:2, and copolymers of 1-alkenes of from about six to about twenty-eight carbon atoms and acrylonitrile in a molar ratio of from about 2:1 to about 1:2.

30. A composition as set forth in claim 29 wherein the nitrilic polymer is selected from the group consisting of copolymers of alkylvinyl monomers and acrylonitrile in a molar ratio of from about 3:2 to about 1:2, and copolymers of 1-alkenes of from about six to about twenty-eight carbon atoms and acrylonitrile in a molar ratio of from about 3:2 to about 1:2.

31. A composition as set forth in claim 30 wherein the nitrilic polymer is selected from the group consisting of copolymers of alkylvinyl monomers and acrylonitrile in a molar ratio of from about 1:1.2 to about 2:3, and copolymers of 1-alkenes of from about six to about twenty-eight carbon atoms and acrylonitrile in a molar ratio of from about 1:1.2 to about 2:3.

32. A composition as set forth in claim 25 wherein the liquid hydrocarbon is a refined hydrocarbon containing less than about 500 ppm by weight sulfur.

33. A composition as set forth in claim 32 wherein the liquid hydrocarbon is selected from the group consisting of gasoline, diesel fuel, jet fuel and $C_5$ to $C_8$ alkanes.

34. A composition having increased electrical conductivity, comprising a liquid hydrocarbon and an anti-static amount of a hydrocarbon soluble copolymer comprising x monomer units corresponding to the formula

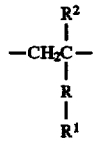

and y monomer units corresponding to the formula

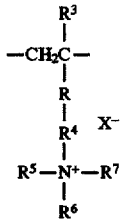

wherein $X^-$ is a nonhalogen anion, R is selected from the group consisting of —C(:O)O—, —C(:O)NH—, straight chain and branched alkylene groups, divalent aromatic groups and divalent alicyclic groups, $R^1$ is a straight chain or branched alkyl of up to about twenty carbon atoms, $R^2$ and $R^5$ are independently selected from the group consisting of hydrogen and methyl, $R^4$ is a straight chain or branched alkylene of up to about twenty carbon atoms, $R^5$, $R^6$ and $R^7$ are independently each a straight chain or branched alkyl of up to about twenty carbon atoms, and x and y are selected such that the copolymer has an average molecular weight of from about 800 to about 1,000,000 and x/y is from about 1 to about 10.

35. A composition as set forth in claim 34 wherein R is —C(:O)O— and the copolymer has an average molecular weight of from about 800 to 500,000.

36. A composition as set forth in claim 35 wherein the monomer units corresponding to the formula

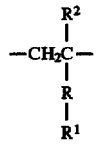

and the formula

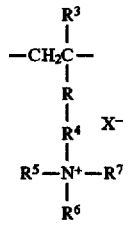

are the only monomer units in the hydrocarbon soluble copolymer.

37. A method for reducing accumulated static electrical charge on a surface of a liquid hydrocarbon, comprising adding to the liquid hydrocarbon an anti-static amount of a hydrocarbon soluble copolymer of an alkylvinyl monomer and a cationic quaternary ammonium vinyl monomer in a molar ratio of from about 1:1 to about 10:1, the copolymer having an average molecular weight of from about 800 to about 1,000,000.

38. A method as set forth in claim 37 wherein the cationic quaternary ammonium vinyl monomer corresponds to the formula

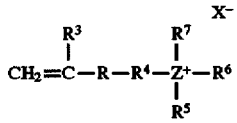

wherein Z is nitrogen, $X^-$ is a nonhalogen anion, R is selected from the group consisting of —C(:O)O—, —C(:O)NH—, straight chain and branched alkylene groups, divalent aromatic groups and divalent alicyclic groups, $R^3$ is selected from the group consisting of hydrogen and methyl, $R^4$ is a straight chain or branched alkylene of up to about twenty carbon atoms, and $R^5$, $R^6$ and $R^7$ are independently each a straight chain or branched alkyl of up to about twenty carbon atoms.

39. A method as set forth in claim 37 wherein $X^-$ is selected from the group consisting of nitrate, sulfate and hydroxide anions, and R has up to about twenty carbon atoms.

40. A method as set forth in claim 39 wherein $X^-$ is a monomethlysulfate ion and R is —C(:O)O—.

41. A method as set forth in claim 38, further comprising adding to the liquid hydrocarbon an anti-static improving amount of an agent selected from the group consisting of nitrilic polymers, magnesium and aluminum overbases and polyvalent metal salts.

42. A method as set forth in claim 41 wherein the agent is a nitrilic polymer having a molecular weight of from about 1,000 to about 100,000 and is selected from the group consisting of copolymers of alkylvinyl monomers and acrylonitrile in a molar ratio of from about 2:1 to about 1:5, copolymers of 1-alkenes of from about six to about twenty-eight carbon atoms and acrylonitrile in a molar ratio of from about 2:1 to about 1:5, and poly(butadiene-acrylonitrile) diols.

43. A method as set forth in claim 42 wherein the nitrilic polymer is selected from the group consisting of copolymers of alkylvinyl monomers and acrylonitrile in a molar ratio of from about 2:1 to about 1:5, and copolymers of 1-alkenes of from about six to about twenty-eight carbon atoms and acrylonitrile in a molar ratio of from about 2:1 to about 1:5.

44. A method as set forth in claim 43 wherein the copolymer further comprises styrene monomer units in a numerical average nitrile monomer unit to styrene monomer unit ratio of from about 5:1 to about 20:1.

45. A method as set forth in claim 43 wherein the nitrilic polymer is present in a nitrilic polymer to hydrocarbon soluble copolymer ratio of from about 9:1 to about 1:9.

46. A method as set forth in claim 43 wherein the nitrilic polymer is selected from the group consisting of copolymers of alkylvinyl monomers and acrylonitrile in a molar ratio of from about 2:1 to about 1:2, and copolymers of 1-alkenes of from about six to about twenty-eight carbon atoms and acrylonitrile in a molar ratio of from about 2:1 to about 1:2.

47. A method as set forth in claim 46 wherein the nitrilic polymer is selected from the group consisting of copolymers of alkylvinyl monomers and acrylonitrile in a molar ratio of from about 3:2 to about 1:2, and copolymers of 1-alkenes of from about six to about twenty-eight carbon atoms and acrylonitrile in a molar ratio of from about 3:2 to about 1:2.

48. A method as set forth in claim 47 wherein the nitrilic polymer is selected from the group consisting of copolymers of alkylvinyl monomers and acrylonitrile in a molar ratio of from about 1:1.2 to about 2:3, and copolymers of 1-alkenes of from about six to about twenty-eight carbon atoms and acrylonitrile in a molar ratio of from about 1:1.2 to about 2:3.

49. A method as set forth in claim 42 wherein the hydrocarbon soluble copolymer and the agent are added to the liquid hydrocarbon by adding to the liquid hydrocarbon a composition comprising the hydrocarbon soluble copolymer and the agent.

50. A method as set forth in claim 42 wherein the liquid hydrocarbon is a refined hydrocarbon containing less than about 500 ppm by weight sulfur.

51. A method as set forth in claim 50 wherein the liquid hydrocarbon is selected from the group consisting of gasoline, diesel fuel and jet fuel.

52. A hydrocarbon soluble copolymer of an alkylvinyl monomer and a cationic vinyl monomer in a molar ratio of from about 1:1 to about 10:1, the copolymer having an average molecular weight of from about 800 to 1,000,000.

* * * * *